US005125122A

United States Patent [19]

Chen

[11] Patent Number: 5,125,122

[45] Date of Patent: Jun. 30, 1992

[54] TILTABLE BED MECHANISM

[76] Inventor: Mau-Shen Chen, 13-6, Hwan Shan Lane 2, Rin Fu Rin Fu Shiang, Taichung, Taiwan

[21] Appl. No.: 633,936

[22] Filed: Dec. 26, 1990

[51] Int. Cl.[5] ..... A61G 7/008; A61G 7/015

[52] U.S. Cl. ..... 5/618; 5/607; 5/613

[58] Field of Search ..... 5/66–69, 5/62, 63, 64, 60, 600, 607, 613–618

[56] References Cited

U.S. PATENT DOCUMENTS 4,685,159 8/1987 Oetiker ..... 5/63

*Primary Examiner*—Alexander Grosz

[57] ABSTRACT

A tiltable bed mechanism for facilitating user turning and raising comprises a frame assembly which contains twelve frames, a supporting and actuating mechanism, and a base. The supporting and driving mechanism comprises two elevator frames, a push rod, worm gear, three support rods, two crank linkages, two struts and three driving rods. The three driving rods are supported by three support rods respectively. The base is disposed under the support rods. The supporting and actuating mechanism is disposed under the frame assembly.

3 Claims, 4 Drawing Sheets

TILTABLE BED MECHANISM

BACKGROUND OF THE PRESENT INVENTION

The present invention relates to a tilting bed mechanism for convalescents and more particularly to a tilting bed that can facilitate either the raising of the head and legs of a patient or the turning of the patient's body to its side.

There are two types of conventional tilting bed mechanisms in common use in such institutions as hospitals and convalescence homes.

A first type of conventional tilting bed offers the function of turning a patient, lying on the bed, to his side. A second type of conventional tilting bed can raise the head or the legs of a patient reclined on the bed.

The tilting bed of the present invention provides for both functions in a cost-effective and relatively low cost mechanism.

The principal object of the present invention is to provide a tilting bed mechanism that can bend a mattress so that a user lying on the bed can be either turned to one side or have his head or legs raised.

Another object of the present invention is to provide a tiltable bed mechanism that is easy to operate and relatively simple to manufacture.

Accordingly, the tiltable bed mechanism combines the mechanical functions of turning a user lying on his back on the mattress, supported by the tiltable bed mechanism, to the his left side or right side or alternately, move either or both, his head and torso upwards or his feet and legs upwards.

The invention is hereinafter described with reference to the accompanying drawings in which.

Figure 1:
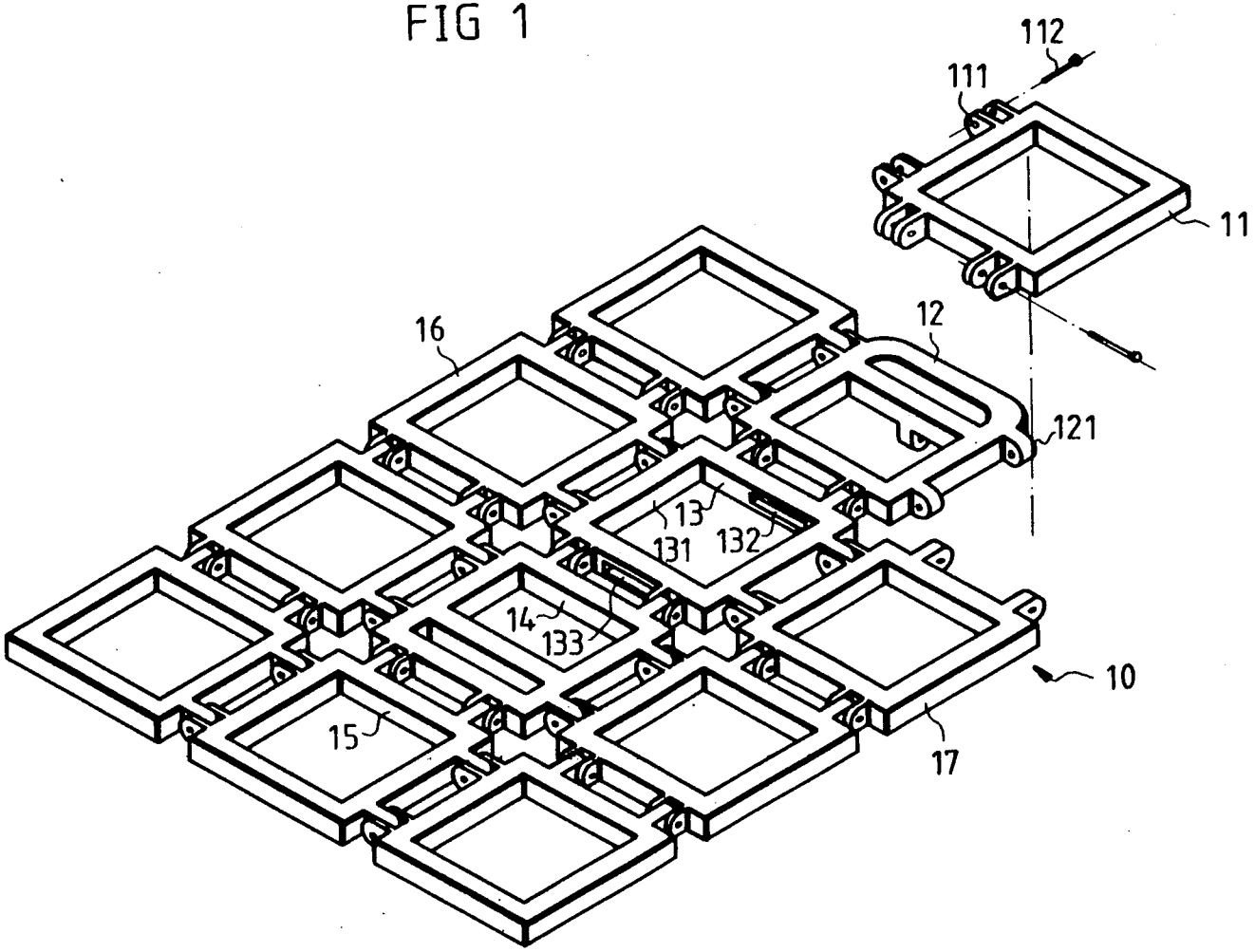
FIG. 1 is a perspective view of the frame assembly of a preferred embodiment of the present invention.

Referring to FIG. 1, a frame assembly 10, on which a mattress will lie when in actual use, contains twelve frames. Considering frame 13 as the central frame, frames 12, 13, 14, and 15 are arranged along a longitudinal direction and frames 16, 13, and 17 are arranged along a transverse direction. Any two abutting frames are connected by female hinge connectors 111 and male hinge connectors 121. The female hinge connectors 111 and male hinge connectors 121 are pivotally joined by pin 112.

Figure 2:
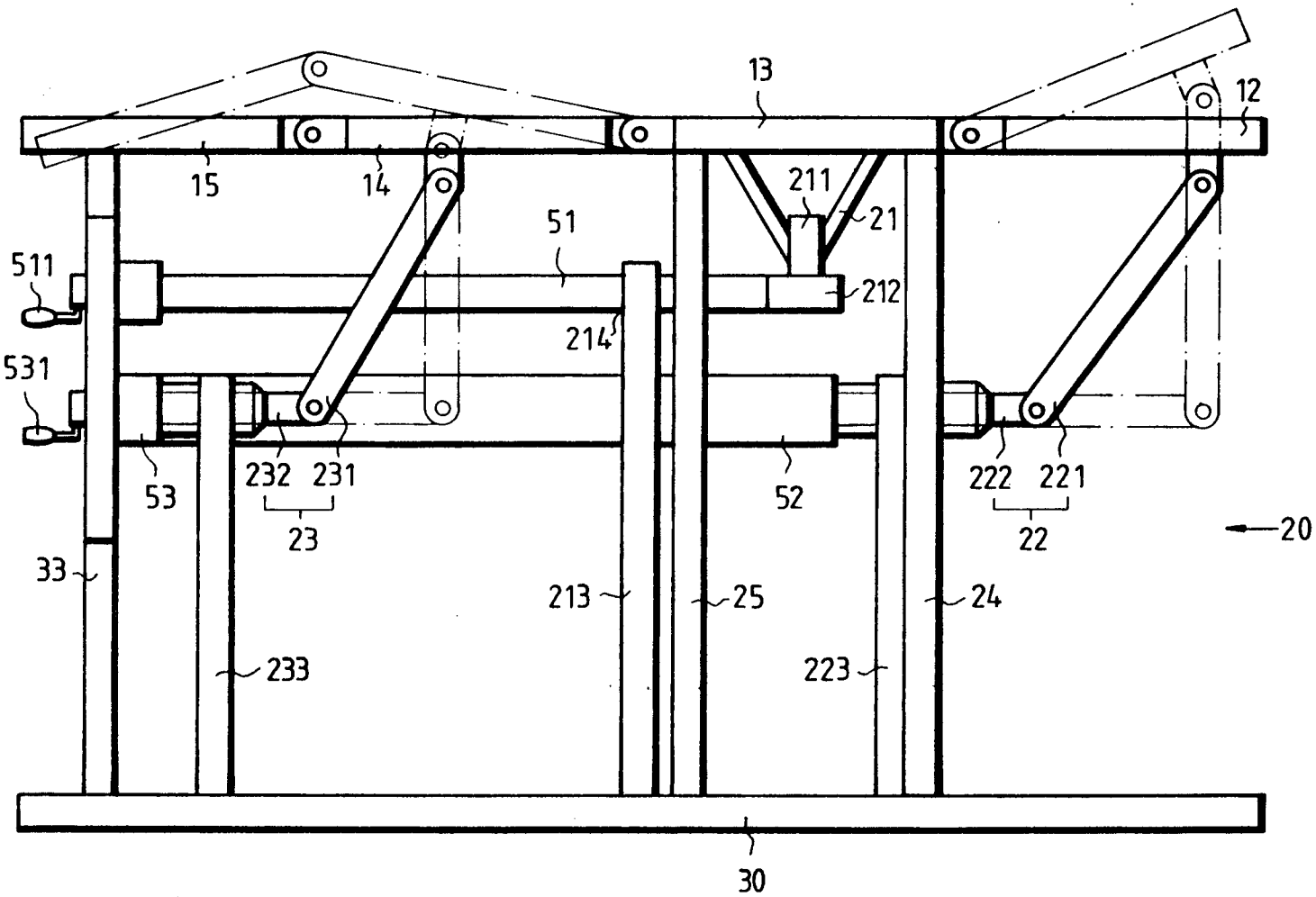
FIG. 2 is a longitudinal side view of the actuating assembly for the frame assembly and shows the operation of raising the head portion or leg portion of the frame assembly.
Figure 3:
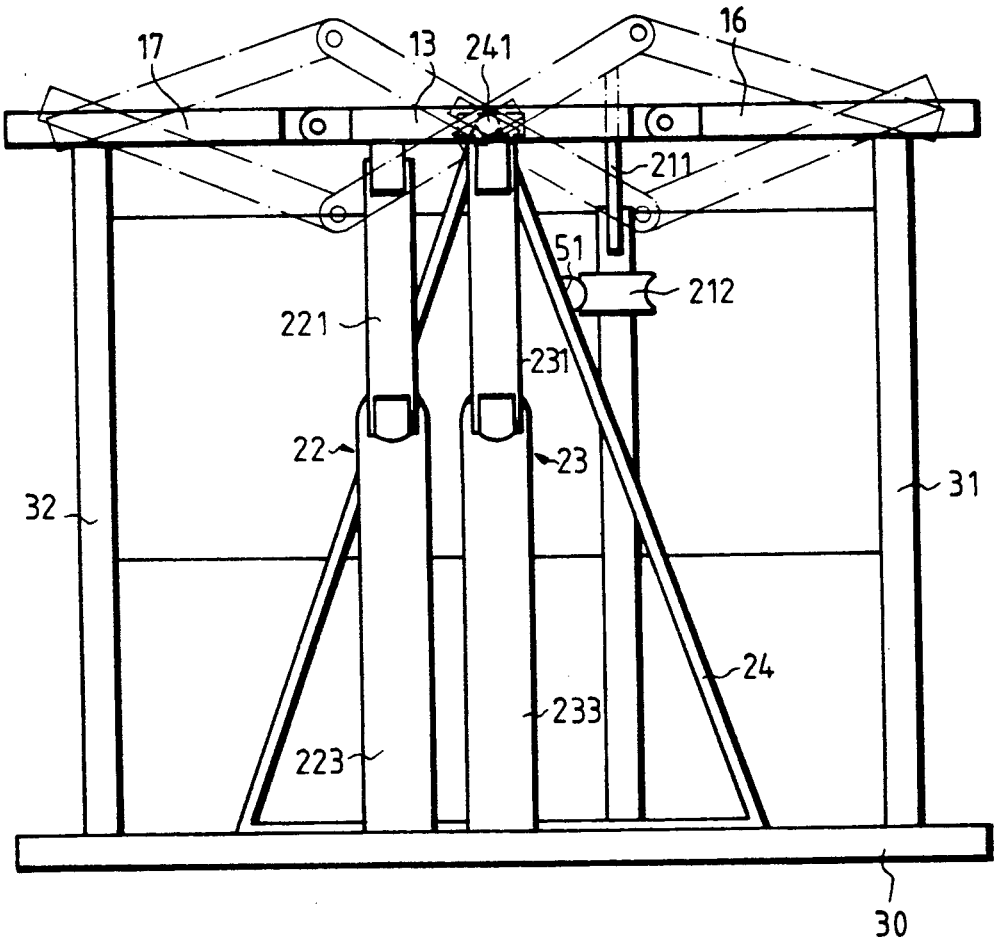
FIG. 3 is a transverse side view of the actuating assembly for the frame assembly and shows the operation of raising and inclining the frame assembly to turn a user's body to the left side.
Figure 4:
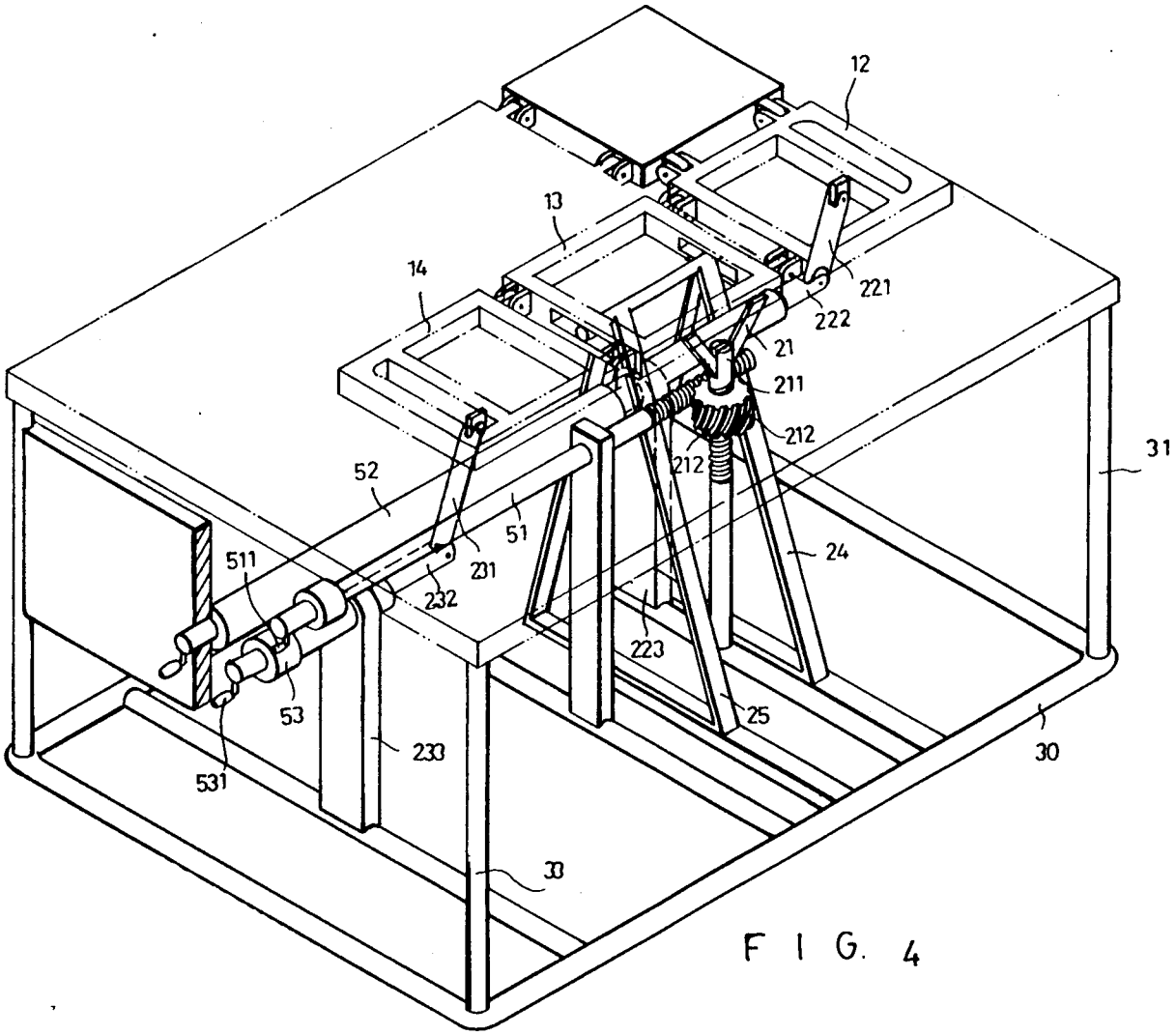
FIG. 4 is a perspective view of the actuating assembly, with the frame assembly thereon in a flat position.

Referring to FIGS. 2, 3 and 4, an actuating assembly for facilitating manual turning and raising of the bed frame assembly 10 comprises a supporting and actuating mechanism 20, and a base 30. The supporting and actuating mechanism 20 which is disposed under the frame assembly 10 comprises two elevator frames 21, a push rod 211, a worm gear 212, three vertical support rods 213, 223, and 233, two crank linkages 22 and 23, and two struts 24 and 25.

The crank linkage 22 has a throw crank 221 and a main crank 222; likewise the crank linkage 23 has a throw crank 231 and a main crank 232. A first side 131 of frame 13 is supported by the two elevator frames 21 hereunder. The push rod 211 which is pivotally connected with elevator frames 21 is driven by worm gear 212. The inner thread of the worm gear 212 is engaged with the outer threads formed on the periphery of the lower end of push rod 211. The worm which is formed at the periphery of one end of first driving rod 51 is engaged with the outer gear of the worm gear 212.

The throw cranks 221 and 231 are disposed under the frames 12 and 14, respectively. The first driving rod 51 is rotatably supported by the first support rod 213. A bearing is disposed at the upper end 214 of the first support rod 213 to support the rotation of first driving rod 51. The male screw formed on the main cranks 222 and 232 are engaged with the female screw at the ends of the second and third driving rods 52 and 53, respectively.

The main cranks 222 and 232 are supported by the second and third support rods 223 and 233, respectively. The female threaded screws in the end of the second and third support rods 223 and 233 are engaged with the male threaded screw on the end portion of the main cranks 222 and 232, respectively.

Referring to FIGS. 1 to 3, two bearings 241 are disposed respectively in the apertures 132 and 133 on the second and fourth sides of the frame 13 along the transverse direction. Two struts 24 are connected by a bar which is inserted through bearings 241. The two struts 24 assume a V shape relative orientation. Two struts 25 are parallel with the two struts 24 respectively. The struts 24 and 25 are disposed under the frame 13.

A base 30 is parallel with the frame assembly 10 and positions the support rods 213, 223, and 233, the struts 24 and 25, and two supports 31 and 32, perpendicularly. The supports 31 and 32 are disposed between the base 30 and the frames 16 and 17, frame 15 and the base 30. A handle 511 and two handles 531 pass through the plate 33.

Referring to FIGS. 2 and 3, the driving rod 51 is rotated through the handle 511 and the driving rods 52 and 53 are rotated through the handles 531, respectively. When the handles 531 are rotated by a user, the throw cranks 221 and 231 will be raised. When the throw crank 221 is raised, frame 12 is raised also so that the head portion of the user's body is raised. When the throw crank 231 is raised, frame 14 is raised and frame 15 is also raised so that the leg portions of the user's body are raised.

When the handle 511 is rotated by the user, elevator frames 21 ascend or descend so that frame 13 can be turned. When the elevator frames 21 ascend, a user's body will be turned from a position of lying on his back to a position of lying on his right side. When the elevator frames 21 descend, the user's body will be turned from a position of lying on his back to a position of lying on his left side.

Further modification of the invention herein described will occur to persons skilled in the art and all such modifications are deemed to be within the scope of the invention as defined by the appended claims.

I claim:

1. A tiltable bed mechanism for facilitating user turning and raising comprising:

a frame assembly comprising a plurality of frames;

a predetermined number of female pivot connectors and male pivot connectors disposed among said frames;

a supporting and actuating mechanism comprising two elevator frames (21), a push rod, a worm gear, a first, second, and third support rods, a first and second crank linkages, a first and second strut, and first, second, and third driving rods;

said first crank linkage comprising a throw crank and a main crank;

said second crank linkage comprising a throw crank and a main crank;

wherein, one end of said first crank linkage, one end of said second crank linkage and said elevator frame are disposed under the predetermined positions of said frame assembly;

said actuating mechanism is disposed under said frame assembly;

the other end of said first crank linkage is connected with said second driving rod;

the other end of said second crank linkage is connected with said third driving rod;

said elevator frames are connected with said push rod;

said push rod is connected with said worm gear;

said worm wheel is connected with said first driving rod;

said first, second and third driving rods are supported by first, second and third support rods respectively;

a base disposed under and rigidly securing said support rods.

2. A tiltable bed mechanism for facilitating user turning and raising as claimed in claim 1, wherein said frame assembly comprises twelve frames.

3. A bed assembly for facilitating user turning and raising as claimed in claim 1, wherein a first, a second, and a third handles are rigidly connected with said first, second, and third driving rods, respectively, wherein a user can manually operate said driving rods with his hands.

* * * * *